US005865686A

United States Patent [19]

MacGregor

[11] Patent Number: 5,865,686

[45] Date of Patent: Feb. 2, 1999

[54] GOLF CLUB SWING TRAINING DEVICE AND METHOD

[76] Inventor: Duncan S. MacGregor, 1988 MacGregor Rd., Tarpon Springs, Fla. 34689

[21] Appl. No.: 768,344

[22] Filed: Dec. 17, 1996

[51] Int. Cl.[6] ..... A63B 69/36

[52] U.S. Cl. ..... 473/228; 473/256; 473/409; 482/109; 482/111

[58] Field of Search ..... 473/256, 318, 473/229, 409; 482/109, 111

[56] References Cited

U.S. PATENT DOCUMENTS

| | | | |
|---|---|---|---|
| 1,662,712 | 3/1928 | Mensing | 473/318 |
| 1,930,342 | 10/1933 | Graham | 473/256 X |
| 3,428,325 | 2/1969 | Atkinson | 473/256 |
| 3,938,570 | 2/1976 | Stewart | 473/256 X |
| 4,079,936 | 3/1978 | Schachter . | |
| 4,118,033 | 10/1978 | Miyamoto . | |
| 4,343,473 | 8/1982 | Laursen . | |
| 4,505,454 | 3/1985 | Gargarin . | |
| 4,982,963 | 1/1991 | Fazio et al. | 473/256 |
| 5,026,063 | 6/1991 | Rhodes . | |
| 5,219,163 | 6/1993 | Watson . | |
| 5,348,296 | 9/1994 | Frederikson . | |
| 5,405,139 | 4/1995 | Gargarin . | |

*Primary Examiner*—George J. Marlo
*Attorney, Agent, or Firm*—Joseph C. Mason, Jr.

[57] ABSTRACT

A method and device for golf swing training involving an elongated flexible member having grip at its proximal end, and a symmetrical weight at its distal end.

A cap covers and is attached to the exterior surface of the weight. The cap has structure on its outer surface for retarding the flow of air around the weight, whereby the means for retarding air flow creates resistance to swinging of the device, and the user experiences a feel comparable to swinging a golf club.

12 Claims, 4 Drawing Sheets

GOLF CLUB SWING TRAINING DEVICE AND METHOD

FIELD OF INVENTION

This invention relates to a device which may be used to refine and improve the swinging of a golf club.

DESCRIPTION OF THE PRIOR ART

One of the most difficult aspects of golf is the ability to correctly swing a golf club. In effort to assist golfers in improving golfers' swing, many books, films, and training devices have been developed. Almost all treat separate major aspects of the swing. When in fact there are many variables. However, as in most sports, practice makes perfect. The swing of a professional golfer is smooth and rhythmic with a tempo. The more repetition, the better the body learns to coordinate the variables necessary for a more perfect swing and learns the "feel" of a perfect swing. This "feel," which is developed, is known as muscle memory. Of course, these traditional training aids make the point of developing muscle memory; however, most devices for such practice have been constructed to look like an actual golf club. Such devices by their very construction forces the golfer to take only a few number of practice swings in a given period of time and, accordingly, limit the ability to develop this muscle memory. An example of this type device is disclosed in U.S. Pat. No. 4,982,963 to Fazio et al. Such a training device results in the golfer having to spend a lot of time to get in a large number of practice swings, which are necessary for the body to learn to coordinate the numerous variables to develop a swing which is smooth and rhythmic with a tempo. But the problem is that most golfers do not have time to spend swinging such devices the necessary number of times for the body to accomplish the required coordination and for the golfer to develop the muscle memory, i.e., "feel," of swinging the club correctly. Also, these realistic clubs distract the golfer's attention from concentrating only on the swing, such as, aligning the club head face correctly in relation to the golfer and golf ball. By making a device which is not a "realistic" type of club, a golfer will not be distracted from the swing. But the device must sufficiently emulate the swing of the club so that the practice swings will be correctly executed. One example of an attempt at this type of practice device is disclosed in U.S. Pat. No. 3,29,980 to Silberman. The device used a rope and was not constructed as a "realistic" golf club, but it did not emulate the conditions of a golf club as being swung and, therefore, lacked the "feel" of a golf club. The same problem occurred with the device disclosed in U.S. Pat. No. 4,128,033 to Miyamoto. That device did not sufficiently isolate the golfer's attention to the golf swing, it was short and heavy, and, consequently, lacked the "feel" of an actual golf club swing. Therefore, what is needed is a training device which will allow a golfer to execute many swings in a short time, slow the swinging action and accurately emulate the "feel" of the swing of any type golf club without the distractions caused by the physical construction of the device.

SUMMARY OF THE INVENTION

This invention provides a unique device for refining and improving a golfer's swing through a rapid number of repetitive swings which provides the "feel" of an actual golf club swing and allow the golfer to adjust all aspects of his or her swing.

According to the present invention, a device is provided which comprises an elongated flexible member of a predetermined length having a proximal and distal end, with a grip means at the proximal end, weight means at the distal end, a cap covering the weight means and extending a predetermined distance from the distal end.

However, it is to be understood that the invention is not limited to the details disclosed, but includes all such variations and modifications as fall within the spirit of the invention and the scope of the appended claims.

DETAILED DESCRIPTION OF THE INVENTION

Figure 1:
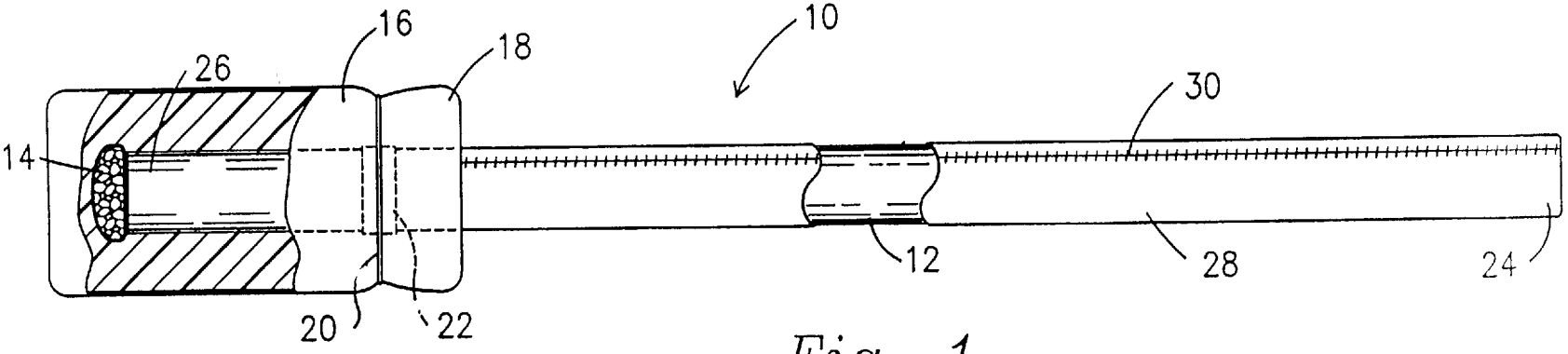
FIG. 1 is an side elevational view of the device with a partial longitudinal sectional view of the distal end.

One embodiment of the present invention is shown at FIG. 1. The device 10 includes an elongated flexible member 12 of a predetermined length, which has a distal end 26 and proximal end 24. The elongated flexible member 12 in this embodiment is composed of closed cell polyethylene foam. The length can be from 37 to 46 inches, but in this embodiment it is about 43 inches. However, it can be composed of many other resilient and flexible materials, such as, polypropylene, polyvinylcloride, neoprene, or polyurethane, or any combination of such materials. While the density of the polyethylene for the elongated flexible member 12 can be from 1.5 to 4 pounds per cubic foot, it is preferably two pounds per cubic foot. The density of the other possible materials should approximate that of the polyethylene. The diameter of the elongated flexible member 12 can be from 1.75 to 3.75 inches. A weight 14 is attached to the distal end 26 of the elongated flexible member 12. The term "attach" is intended to include secure, fasten and adhere. The total weight for the device 10 may be from seven to twenty ounces, so the weight 14 should be adapted to give this result, which is usually from one to six ounces. Typically, the device 10 has an overall weight of thirteen ounces and the weight 14 is two ounces. The weight 14 may be composed of a plurality of small weights; although as will be seen in later embodiments the weight 14 can be a single piece. Also, weight 14 may be secured to or formed as part of the elongated flexible member 12; however, it can be unsecured to elongated flexible member 12 and instead placed inside the cap 16 or may be secured to or formed as part of the cap 16 as long as the weight 14 is symmetrically disposed relative to the longitudinal axis of the flexible member 12, as shown on the drawings. Preferably, the elongated flexible member 12 is covered by a cover means 28, which can be either elastic or nonelastic. The covering means 28 may be a spandex material, but any other material of similar thickness may be used. The covering means 28 may be secured to the elongated flexible member 12 by a covering attachment means 30, which may be a typical sewn closure. However, any known securing means may be used, such as, glue, zipper, buttons, snaps, or hook and loop fastening material. The distal end 26 and weight 14 are covered by a cap 16 having a receiving end 18. The cap 16, in this embodiment, is composed of a fabric with a short pile on its exterior surface. The pile is approximately ¼ inch in length, but may be from 1/16 to 1 inch in length. While any type of rough or contoured material may be used, such as, plain fabric, plastic, metal, or wood, a fabric with a short pile is preferable. As the device 10 is being swung, air resistance on the pile creates a retarding force upon the device 10. In using other materials, this retarding force can be created by configuring these materials with sufficient roughness, protrusions, openings, or cavities to cause sufficient resistance to the movement of the air by means known in the art. An example of such configuring of plastic is explained below. The amount of the retarding force created by the air resistance against the cap 16 can be adjusted by configuring the cap 16. This retarding force should be adjusted so as to create a "feel" for the head of the golf club as though on a normal golf club during a swing. The cap 16 is attached to the elongated flexible member 12 by an interior attachment means 22 and an exterior attachment means 20. While this embodiment and the other embodiments show both interior attachment means 22 and exterior attachment means 20, either attachment means may be used by itself. The interior attachment means 22 in this embodiment is a strip of tape with adhesive on both sides. However, other attachment means may be used, such as, glue, or hoop and loop material attached to the interior of the cap 16 and the exterior surface of the elongated flexible member 12. The exterior attachment means 20 in this embodiment was a plastic strap integrally formed to the exterior surface of the cap 16 by a fastening means. Instead of plastic, other material may be used, such as, synthetic or natural fiber, rubber, metal, or neoprene.

Figure 2:
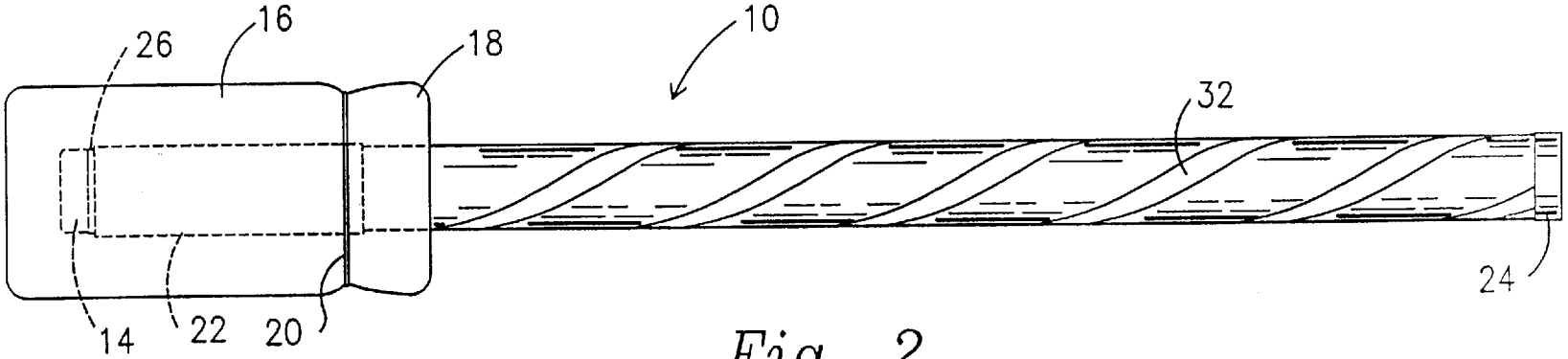
FIG. 2 is a side elevational view of the device illustrating an alternate embodiment of the elongated flexible member.

Another embodiment of the invention is shown in FIG.2. In this embodiment, the covering means 28 is a plurality of strips of material 32 attached to the exterior surface of the elongated flexible member 12 and extending along the longitudinal axis of the elongated flexible member 12. The strips of material 32 may be aligned along the outer surface of the elongated flexible member 12 in any configuration, such as, spiral, criss-cross or linear. The use of the strips enables the feel of the device 10 to be altered to more precisely imitate the feel of a particular type golf club and strengthens the member 12. Additionally, as shown in FIG.2, the interior attachment means 22 is an adhesive applied to the distal end 26 of the elongated flexible member 12 which is in contact with the cap 16. As further shown in FIG. 2, the weight 14 is of one piece construction.

Figure 3:
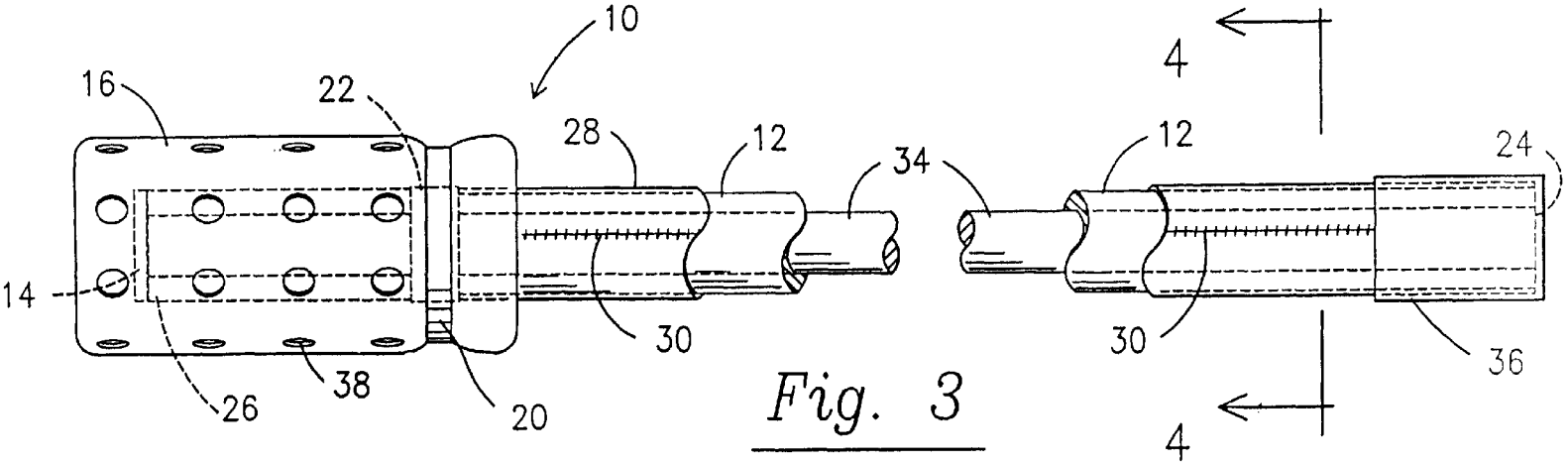
FIG. 3 is a side elevational view of the device with a partial longitudinal sectional view of the elongated flexible member embodied as having a core member.

Still another embodiment is shown in FIG. 3, which illustrates the elongated flexible member 12 having a core member 34 made of a slightly less flexible material, such as, plastic, metal, rope or cable. The core member 34 may extend the entire length of the elongated flexible member 12 along the longitudinal axis of the elongated flexible member 12. Also, the core member 34 may only extend part of the length of the elongated flexible member 12. The core member 34 can be used instead of or in combination with the strips 32 to alter the feel of the device 10 to more precisely imitate the "feel" of a particular type golf club. Additionally, it shows the elongated flexible member 12 with a handle or grip means 36 at the proximal end 24. The handle means 36 may be smaller in diameter than the elongated flexible member 12. Further, the cap 16 is a flexible plastic shell with holes in its walls. Although the holes shown are circular in shape, they may be of any shape. With the cap 16 in this configuration, there must be a plurality of spaces 38 between the exterior surface of the elongated flexible member 12 and the interior surface of the cap 16 sufficient for a flow of air to be created between the exterior surface of the elongated flexible member 12 and the interior surface of the cap 16. The cap 16 resists the flow of air when the device is in motion and creates a retarding force. This retarding force can be adjusted by configuring the cap 16 so as to create a "feel" for the head of the golf club as though on a normal golf club during a swing. Furthermore, the exterior attachment means 20 is shown as a clamp, although any commonly known attachment means, such as, glue, pin, rivet, hook and loop material, adhesive tape, or bolt, may be used.

Figure 4:
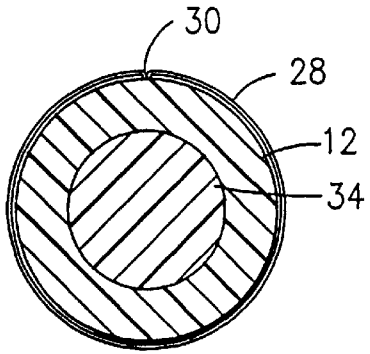
FIG. 4 is a cross sectional view of the elongated flexible member of FIG. 3.

In FIG.4, the cross sectional view of the elongated flexible member 12 with the core member 34, covering 28 and covering attachment means 30.

Figure 5:
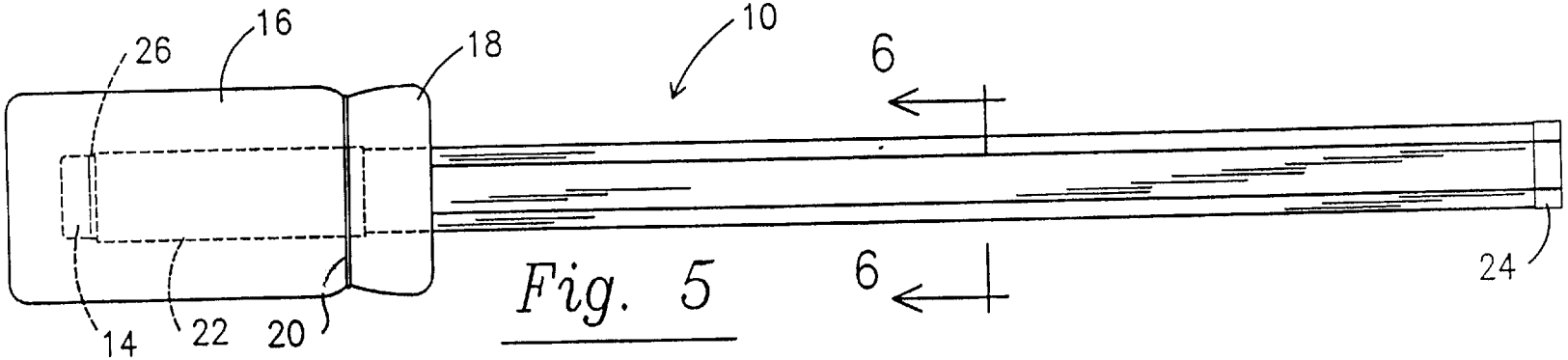
FIG. 5 is a side view of the elongated flexible member of the device with a an octagonal cross section configuration.
Figure 6:
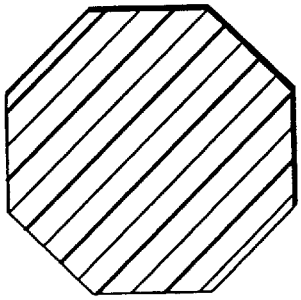
FIG. 6 is a cross-sectional view of FIG. 5.
Figure 7:
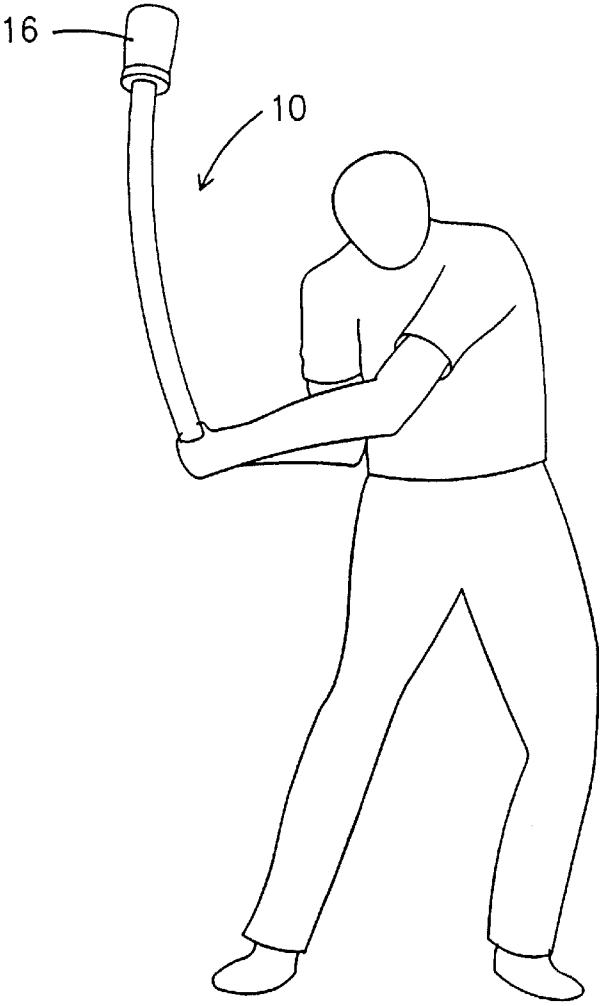
FIG. 7 is a pictorial representation of the device in use.

In the embodiment in FIG.5, the cross sectional view of elongated flexible member 12 shows that the elongated flexible member 12 can be of any configuration. In this case, the configuration is octagonal.

The device 10 can be adapted for use by a child. For use by a child, the overall length of the device 10 should be between 24 to 40 inches; the diameter of the elongated flexible member 12 can be from 0.75 to 1.75 inches; the overall weight of the device 10 should be from three to ten ounces; and the weight 14 should be between 0.5 and 3 ounces.

These embodiments are examples only, the invention is not limited to the details disclosed, but includes all such variations and modifications as fall within the spirit of the invention and the scope of the appended claims.

The operation and use of device 10 is described in the following example: The device 10 is gripped by the golfer using a conventional grip at the proximal end 24 of the elongated flexible member 12. The golfer swings the device 10 in a conventional golf swing. The device 10 is swung as quickly as the golfer believes is helpful, either continuously or in discreet single strokes from the address position. In swinging the device 10 continuously it is meant that the back and forth swinging motion is uninterrupted. When the device 10 is held at the extreme proximal end 24, driving woods are simulated. If held in a choked position, then irons are simulated.

The use of the invention was found to have unexpectedly and dramatically refined and improved the swings of golfers.

The invention claimed is:

1. A device for golf swing training, comprising:

an elongated flexible member having a proximal and distal end;

grip means at the proximal end;

weight means at the distal end, the weight means including an exterior surface and being symmetrically disposed relative to the longitudinal axis of the elongated flexible member;

a cap attached to the exterior surface of the weight means, the cap including means on its outer surface for retarding the flow of air around the weight means, whereby the means for retarding air flow creates resistance to swinging of the device to create a feel comparable to the feel on the head of a golf club during a swing.

2. A device as claimed in claim 1, further comprising:

an elastic fabric covering the elongated flexible member.

3. A device as claimed in claim 1, in which:

the elongated flexible member is a closed cell foam.

4. A device as claimed in claim 1, in which:

the elongated flexible member is rubber.

5. A device as claimed in claim 1, in which:

the elongated flexible member is plastic.

6. A device as claimed in claim 1, in which:

the means for retarding air flow is a fabric with a short pile on its exterior surface.

7. A device as claimed in claim 1, in which:

the elongated flexible member contains a core member formed along a center longitudinal axis of the elongated flexible member, and the core member is a material slightly more rigid than the material of the elongated flexible member.

8. A device as claimed in claim 1, in which:

the elongated flexible member has a handle means of a predetermined length disposed at the proximal end.

9. A device for golf swing training, comprising:

an elongated flexible member between 0.75 to 3.75 inches in diameter and between 24 to 46 inches in length, the elongated flexible member having a proximal and distal end;

grip means at the proximal end;

fabric covering the elongated flexible member;

a weight between 0.5 to 6 ounces at the distal end, the weight including an exterior surface and being symmetrically disposed relative to the longitudinal axis of the elongated flexible member;

a cap attached to the exterior surface of the weight, the cap including means on its outer surface for retarding the flow of air around the weight means, whereby the means for retarding air flow creates resistance to swinging of the device to create a feel comparable to the feel on the head of a agolf club during aswing.

10. A device as claimed in claim 9, in which:

the means for retarding air flow is flexible plastic having an end wall and a side wall mounted about a periphery of the end wall, the side wall projecting outwardly from the end wall and having portions defining a hole, and a cavity defined collectively by the end wall and side wall; and an interior circumference of the cap which is greater than an exterior circumference of the elongated flexible member so that air flows through the portions of the side wall of the cap to create air resistance similar to that of a golf club.

11. The method of practicing swinging a golf club, which comprises:

gripping a proximal end of a device having an elongated flexible member of predetermined length and diameter, and a weight at its distal end symmetrically disposed relative to the longitudinal axis of the elongated flexible member, including a cap covering the weighted distal end and attached thereto, the cap including means on its outer surface for retarding the flow of air around the weighted distal end; and swinging the device in a conventional golf swing and experiencing a feel comparable to swinging a golf club.

12. A method as claimed in claim 11, in which:

swinging the device is in discreet single strokes of a conventional swing;

starting the conventional swing at the address position.

* * * * *